US005673447A

United States Patent [19]

White et al.

[11] Patent Number: 5,673,447

[45] Date of Patent: Oct. 7, 1997

[54] FOOT SUPPORT FOR A BED

[76] Inventors: Roy Wallace White, 8195 San Dimas La., Atascadero, Calif. 93422; Cynthia Ann Lawson, 224 Getchell, Santa Cruz, Calif. 95060

[21] Appl. No.: 719,175

[22] Filed: Sep. 24, 1996

[51] Int. Cl.[6] ..... A47C 20/02

[52] U.S. Cl. ..... 5/651; 5/662

[58] Field of Search ..... 5/624, 649, 650, 5/651, 662, 924, 504, 505.1

[56] References Cited

U.S. PATENT DOCUMENTS

| | | | |
|---|---|---|---|
| 2,340,666 | 2/1944 | Johanson | 5/651 X |
| 3,173,157 | 3/1965 | Maples | 5/651 |
| 3,523,310 | 8/1970 | Shead | 5/651 |
| 3,803,645 | 4/1974 | Oliverius | 5/505.1 X |
| 3,967,334 | 7/1976 | Ricke et al. | 5/505.1 X |
| 4,214,327 | 7/1980 | Smith | 5/651 |

FOREIGN PATENT DOCUMENTS

| | | | |
|---|---|---|---|
| 110586 | 5/1940 | Australia | 5/651 |
| 27498 | of 1910 | United Kingdom | 5/651 |

*Primary Examiner*—Michael F. Trettel
*Attorney, Agent, or Firm*—Daniel C. McKown

[57] ABSTRACT

A foot support for a bed rests on the upper surface of the mattress and includes an upwardly inclined foot plate. Lateral motion and twisting of the foot support with respect to the mattress are prevented by downwardly depending fences that lie adjacent the sides of the mattress. In a preferred embodiment, the foot support consists entirely of flat stock which results in a unitary structure that is easy to clean and that nests so that a number of the foot supports can be stacked for storage in a relatively small space.

2 Claims, 2 Drawing Sheets

FOOT SUPPORT FOR A BED

BACKGROUND OF THE INVENTION

1. Field of the Invention

The present invention is in the field of ancillary equipment for a hospital bed and specifically relates to a foot support for such a bed. The foot support serves to assist the bedridden patient in lying in a partial sitting position, and also serves to keep the weight of the bed covers from bearing against the toes of the patient.

2. The Prior Art

Patients who are expected to be bedridden for a long time are often placed in a type of bed having sections that can be tilted for the comfort of the patient. Usually, the patients finds that a partially sitting position, with the head elevated above the body is preferred.

The difficulty with this preferred position is that the patient has a tendency to slide down toward the foot of the bed. When this happens, a nurse or caregiver must lift the patient and return him to the original position.

Returning the patient to the desired position is physically demanding of the caregiver and also time consuming. Repositioning the patient is also demanding on the patient who may be recovering from an operation and experiencing pain.

The foot support of the present invention provides an inclined panel against which the patient can place his feet to push himself up in the bed by use of his leg muscles or at least to prevent himself from sliding down in the bed. Pushing against the inclined panel also provides a limited and safe form of exercise for the patient's legs.

A search of the prior art revealed that a number of inventors have addressed the problem of designing a foot support for a bed. In U.S. Pat. No. 1,539,082, Fyler shows a foot brace that engages the frame of a bed.

Likewise, the foot board assembly shown in U.S. Pat. No. 3,967,334 of Ricke et al. also engages the frame of the bed and includes a vertical board for the feet. A problem with devices that are attached to the frame of the bed is that as the mattress is tilted they do not move with the mattress and apparently would have to be readjusted.

In U.S. Pat. No. 5,101,526 there is shown a foot support that slips under the mattress and that includes an abutment plate that maintains the spacing between the device and the lower end of the bed.

In U.S. Pat. No. 3,803,645, Oliverius shows an inflatable foot support device that is strapped to the side rails of a bed.

In U.S. Pat. No. 5,295,276, Richards et al. show a foot support that is held in place by straps that extend around the mattress.

After studying the patents of the prior art, the present inventors were struck by several facts. First, the prior art devices were assembled from a large number of parts, which makes the devices more difficult to take apart and reassemble for cleaning, and which raise the possibility that small parts, such as wing nuts would become lost or misplaced or stepped upon by a patient.

Second, it appears that the prior art devices require considerable effort to attach to the bed frame or to the mattress, as the case might be. In most instances it appears that installation of the foot rest would require the coordinated efforts of more than one person.

Further, it appears that the prior art devices require considerable space for storage.

These, and other problems of the prior art devices have been overcome by the design of the present invention, as will be described below.

SUMMARY OF THE INVENTION

It is an objective of the present invention to provide a foot rest that can be installed and removed from a bed by one person.

It is a second objective of the present invention to provide a foot rest that contains a minimum number of parts.

A third objective of the present invention is to provide a foot rest that is nestable so that a number of foot rests can be stacked for storage in a relatively small space.

These objectives are achieved in accordance with a preferred embodiment of the invention by a unitary construction consisting entirely of flat stock. The foot support includes a left and a right base portion that extend along the left and right marginal portions of the upper surface of the mattress so that the foot support rests on the upper surface of the mattress. Lateral stability of the foot support is achieved by left and right fences that extend downward from the left and right bases, respectively. The left and right bases are joined by a cross member that extends across the bed at a location beyond the feet of the patient, and the foot plate extends upwardly at a fixed angle with respect to the base portions.

Because the foot support rests on the mattress, the foot plate maintains the same angle with respect to the mattress as the mattress is tilted to elevate the knees of the patient.

The foot support of the present invention provides simplicity of 1 installation and removal. The attendant simply pulls back the covers, places the foot support on top of the mattress, and then pulls the covers up over it. No tools are required, and there are no small parts that might be misplaced.

Because of its unitary construction, the foot support of the present invention does not need to be disassembled for cleaning and then reassembled.

These and other advantages of the foot support will be seen more clearly from the following description and the accompanying drawings. It is to be understood however that the drawings are for the purpose of illustration and description of the invention and are not intended to limit the scope of the invention.

DETAILED DESCRIPTION OF THE PREFERRED EMBODIMENT

Figure 1:
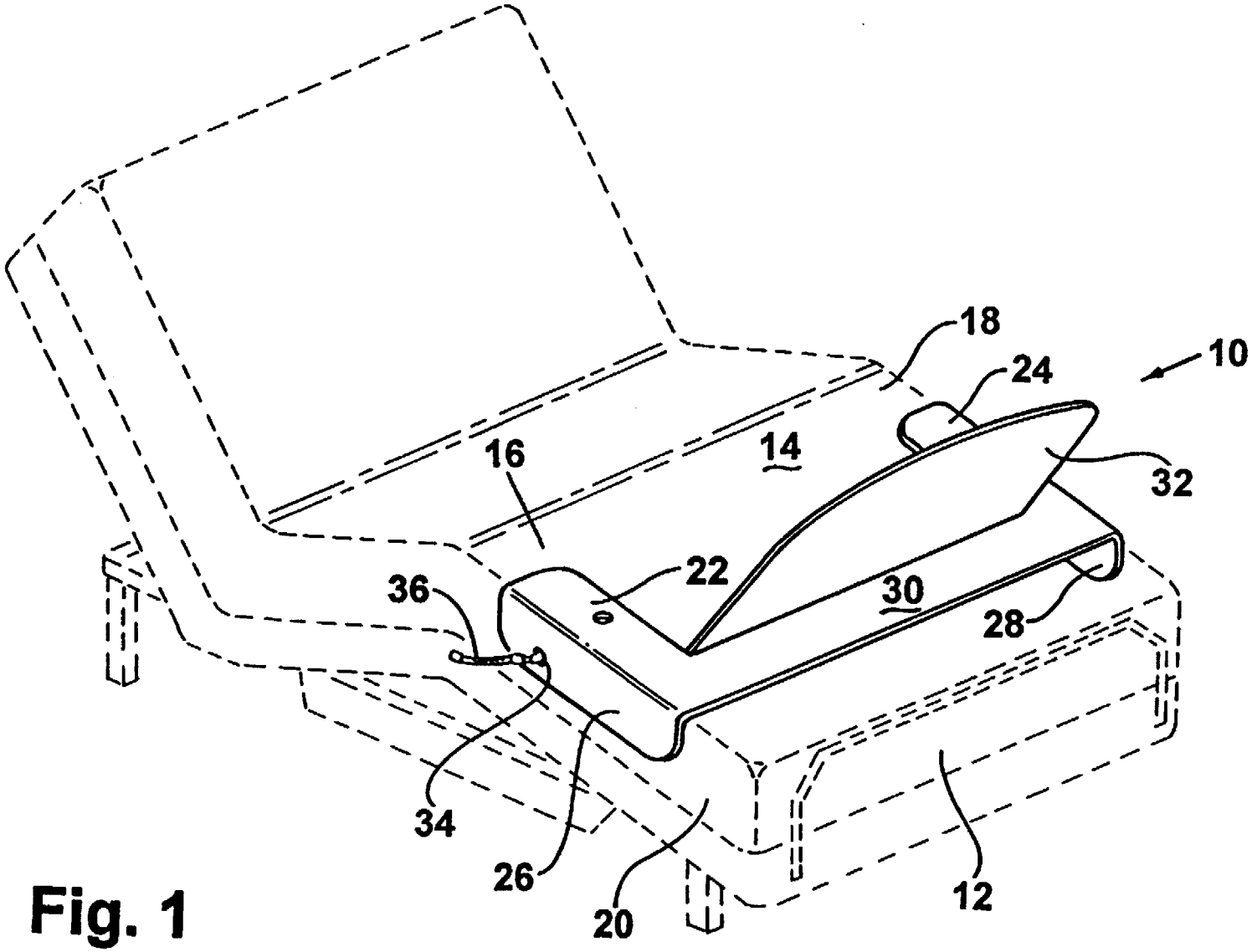
FIG. 1 is a top right rear perspective view showing a preferred embodiment of the foot support of the present invention in place on a mattress which is shown in phantom lines in the drawing.

FIG. 1 is a perspective view looking towards the end 12 of the mattress at the foot of the bed. The foot support 10 is seen to rest on the upper surface 14 of the mattress.

The foot support 10 includes a right base 22 that rests on a right marginal portion 16 of the upper surface and a left base 24 that rests on a left marginal portion 18. A cross member 30 also rests on the upper surface 14 in the preferred embodiment shown in FIG. 1. In an alternative embodiment the cross member 30 rests on the right base 22 and the left base 24.

The foot support 10 is prevented from moving laterally and from turning by a right fence 26 that depends from the right base 22 and that lies adjacent the right side 20 of the mattress. On the opposite side, a left fence 28 depends from the left base 24 and lies against the left side of the mattress. In the preferred embodiment the right and left fences diverge downwardly at a small angle to enable nesting of the foot supports when they are stacked, and to facilitate positioning of the foot supports on the mattress.

In the preferred embodiment of FIG. 1, the foot plate 32 extends upwardly at an angle from the plane of the cross member 30.

A hole 34 is provided in the right fence 26 to permit a strap or cable to be attached to the foot support 10. The other end of the strap or cable 36 can be tied to the frame of the bed. In this manner the foot support 10 can be prevented from sliding toward the foot of the bed if necessary.

Figure 2:
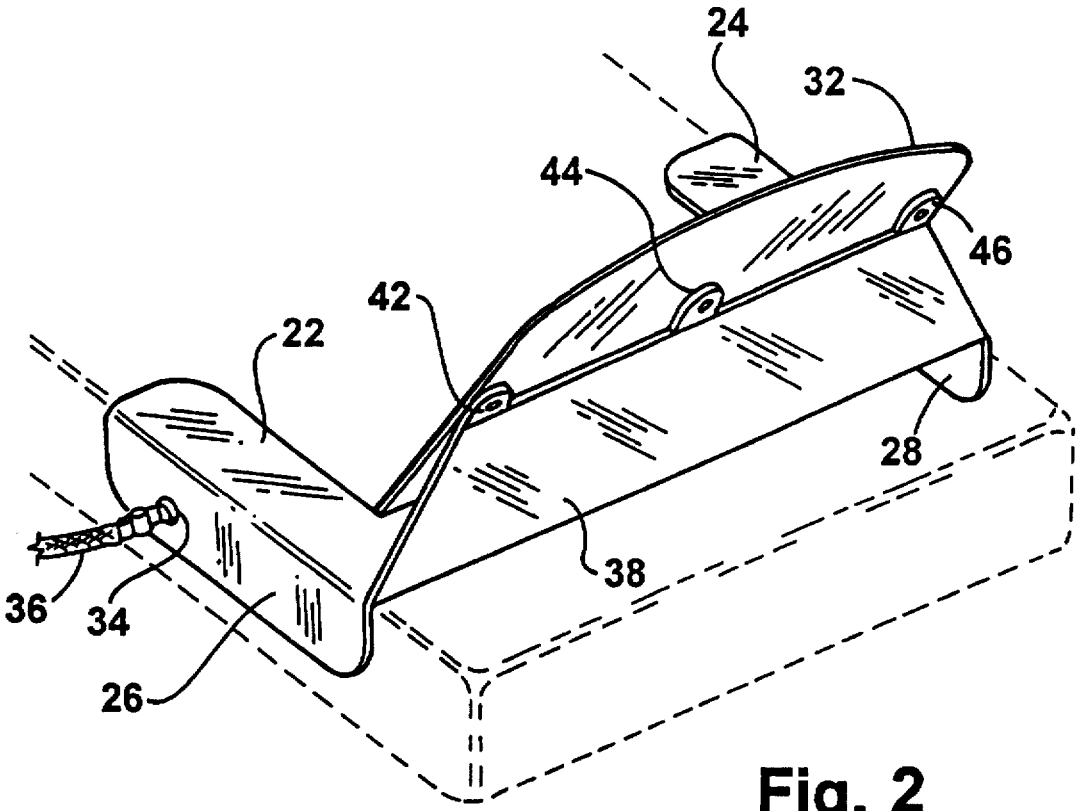
FIG. 2 is a right rear top perspective view of an alternative embodiment of the foot support in place on a mattress, which is shown in phantom lines in the drawing; and, FIG. 3 is a top plan view of a piece of flat stock showing the lines of cutting and bending that result in the foot support of FIG. 2.

The alternative embodiment shown in FIG. 2 differs from the embodiment of FIG. 1 in that the foot plate 32 is supported by a brace 38 and a gusset 40. A similar gusset is provided on the left side of the brace 38. Integral with the brace 38 are the tabs 42, 44 and 46 which are affixed to the foot plate 32.

The embodiment of FIG. 2 is more sturdy than that of FIG. 1, but does not nest as well for stacking.

Figure 3:
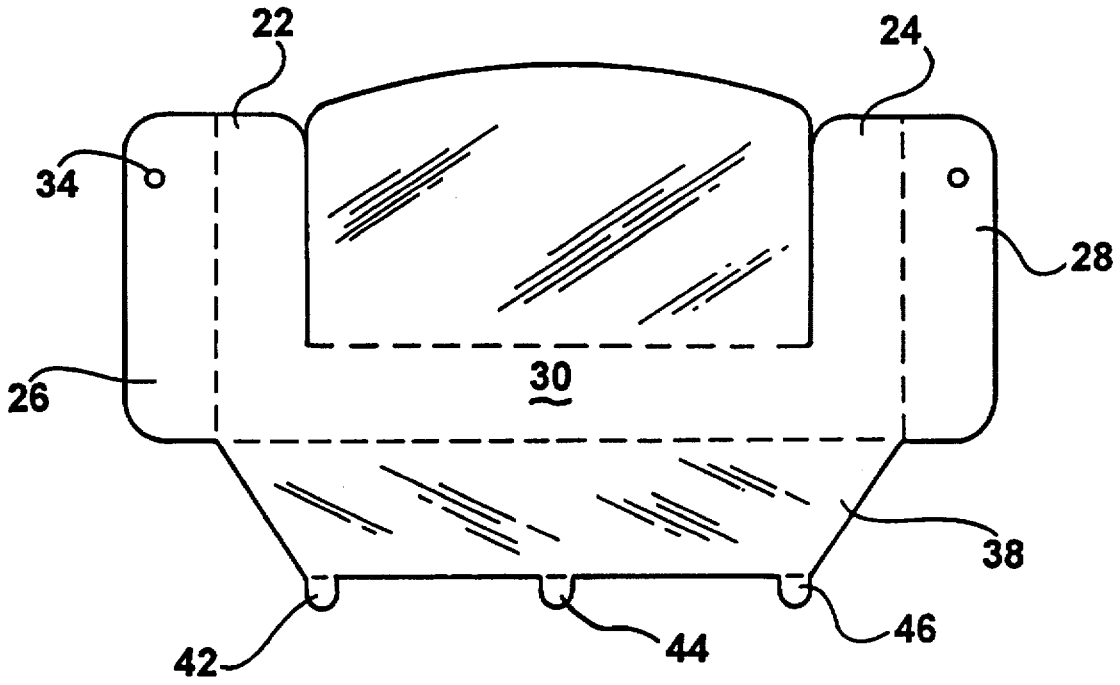

FIG. 3 is a plan view of a sheet of flat stock. The solid lines represent cuts that extend through the flat stock, and the dashed lines indicate bends. FIG. 3 demonstrates that the embodiment of FIG. 2 can be formed entirely of a single piece of flat stock. Accordingly, there are no parts to get lost. No assembly is required, and manufacturing of the foot support should be quite straightforward.

Thus, there has been described a foot support of extremely simple construction and which has the advantage of maintaining its position relative to the mattress even when the mattress is tilted.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. A foot support for a bed including a mattress having an upper surface and having parallel right and left sides, the mattress supported by a bed frame having right and left sides, said foot support comprising:

a right base having a surface lying in a plane and resting upon a right marginal portion of the upper surface of the mattress;

a left base having a surface lying in said plane and resting upon a left marginal portion of the upper surface of the mattress;

a right fence extending down from said right base adjacent the right side of the mattress;

a left fence extending down from said left base adjacent the left side of the mattress;

a cross member extending across the bed and connecting said right base and said left base; and, a foot plate connected to said cross member and extending upward from said cross member;

wherein said right base, said left base, said right fence, said left fence, said cross member and said foot plate are portions of a unitary structure that consists of flat stock.

2. A foot support for a bed including a mattress having an upper surface and having parallel right and left sides, the mattress supported by a bed frame having right and left sides, said foot support comprising:

a right base having a surface lying in a plane and resting upon a right marginal portion of the upper surface of the mattress;

a left base having a surface lying in said plane and resting upon a left marginal portion of the upper surface of the mattress;

a right fence extending down from said right base adjacent the right side of the mattress;

a left fence extending down from said left base adjacent the left side of the mattress;

means attached to said right fence and said left fence for restraining the foot support from sliding toward the foot of the mattress, said means including a right strap and a left strap that are attached respectively to the right and left sides of the bed frame;

a cross member extending across the bed and connecting said right base and said left base; and, a foot plate connected to said cross member and extending upward from said cross member.

* * * * *